US005979898A

United States Patent [19]

Pan

[11] Patent Number: 5,979,898

[45] **Date of Patent: *Nov. 9, 1999**

[54] ELECTRICAL SCORING DART TARGET

[76] Inventor: Francis Pan, No. 7, Tatun 15th St., Taichung, Taiwan

[ * ] Notice: This patent is subject to a terminal disclaimer.

[21] Appl. No.: 08/922,866

[22] Filed: Sep. 3, 1997

[51] Int. Cl.[6] ..... F41J 5/02

[52] U.S. Cl. ..... 273/371

[58] Field of Search ..... 273/371–376, 273/237, 247, 432, 459, 460, 461, 454, DIG. 26; 340/323 R; 364/410.1, 411.1

[56] References Cited

U.S. PATENT DOCUMENTS

| | | | |
|---|---|---|---|
| 4,893,822 | 1/1990 | Tesa et al. | 273/376 |
| 5,370,306 | 12/1994 | Schulze et al. | 273/371 |
| 5,711,528 | 1/1998 | Pan | 273/371 |

*Primary Examiner*—Valencia Martin-Wallace
*Assistant Examiner*—Mark A Sager
*Attorney, Agent, or Firm*—Heller Ehrman White & McAuliffe

[57] ABSTRACT

An electrical scoring dart target, which provides a "soccer" competition, an "American football" competition, as well as other "sport" competitions effect, is disclosed. The dart target includes a target defining a plurality of target areas. The target areas are divided into a frustration region, an offense/defense interaction region, and an offensive gain region. The electrical scoring dart target further includes a control panel disposed below the target and a control circuit provided within the target. The control panel has two sets of score displays and function keys, as well as a clocking display and a pilot lamp indicating attack. The plurality of target areas are configured as a "soccer", "American football", "basketball" or some other "sports" competition ground.

7 Claims, 5 Drawing Sheets

ELECTRICAL SCORING DART TARGET

BACKGROUND OF THE INVENTION

1. Field of the Invention

The present invention relates to an electrical scoring dart target, and more particularly to an improved electrical scoring dart target which provides a "soccer" competition, an "American football" competition, as well as other exciting "sport" competition effects.

2. Description of Related Art

Conventional darts generally is played in a manner of setting scores according to the hit position on the target. The used target generally has a certain pattern on the surface thereof and only can provided a single and simple game mode. With the need for improvement of enjoying indoor games, this kind of darts is neither satisfactory nor attractive. Therefore, it is necessary to develop a kind of more complex game to meet the needs of people.

The present invention provides an improved electrical scoring dart target to mitigate and/or obviate the aforementioned problems.

SUMMARY OF THE INVENTION

One object of the present invention is to provide an improved electrical scoring dart target which provides a "soccer" competition, an "American football" competition, as well as other exciting "sport" competition effects.

In accordance with one aspect of the present invention, an electrical scoring dart target includes a target defining a plurality of target areas. The target areas are divided into a frustration region, an offense/defense interactive region, and an offensive gain region which is adapted for a "soccer" competition, an "American football" competition, and other "sport" competitions. The electrical scoring dart target further includes a control panel disposed below the target and a control circuit provided within the target.

In accordance with another aspect of the present invention, the control panel has two sets of score displays and function keys, as well as a clocking display and a pilot lamp indicating attack.

In accordance with a further aspect of the present invention, the plurality of target areas are configured as a "soccer field", an "American football field", a "basketball court" or other "sports grounds".

Other objects, advantages and novel features of the invention will become more apparent from the following detailed description when taken in conjunction with the accompanying drawings.

DETAILED DESCRIPTION OF PREFERRED EMBODIMENT

Figure 1:
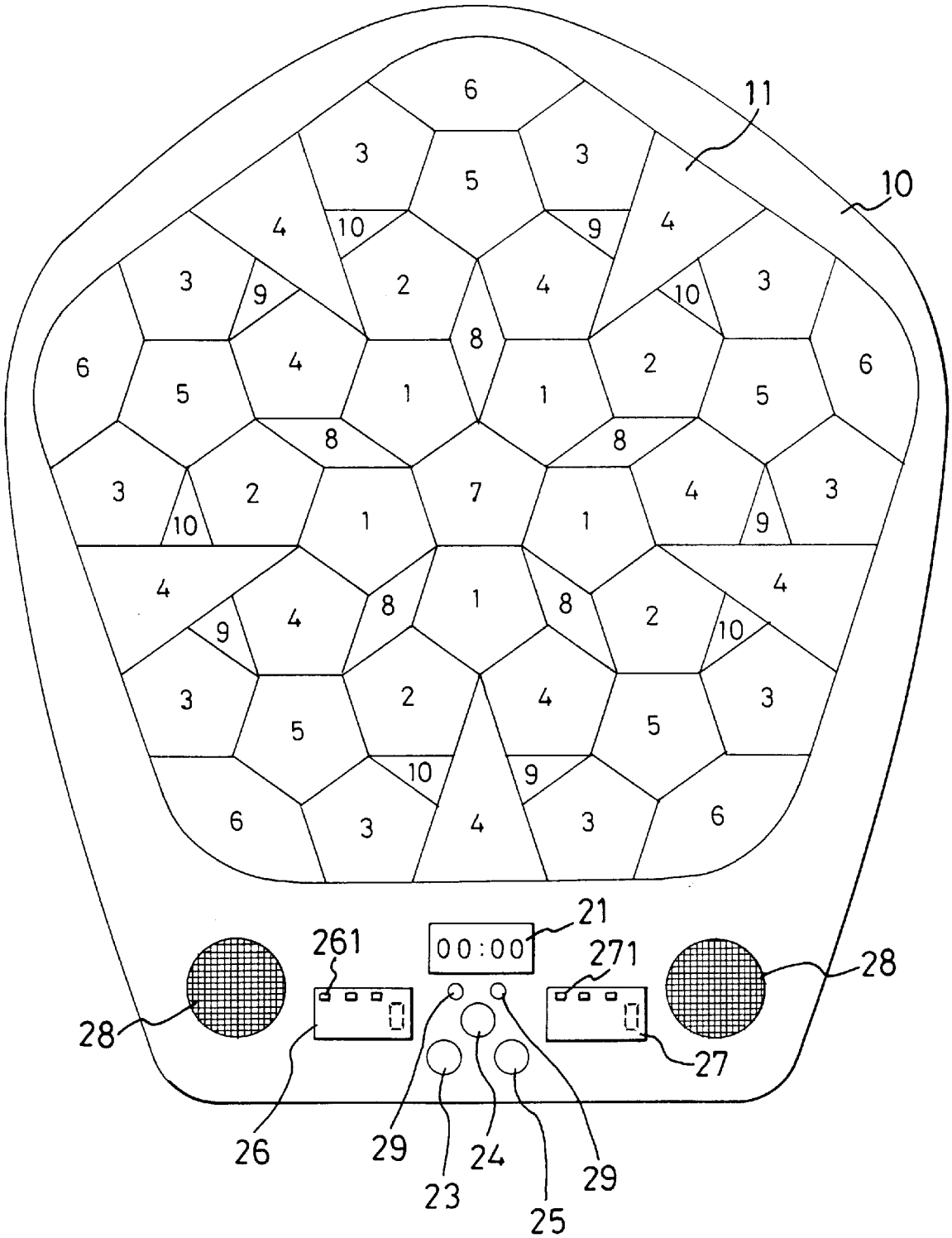
FIG. 1 is a schematic view showing an electrical scoring dart target configured to be a "soccer" competition in accordance with the present invention.
Figure 2:
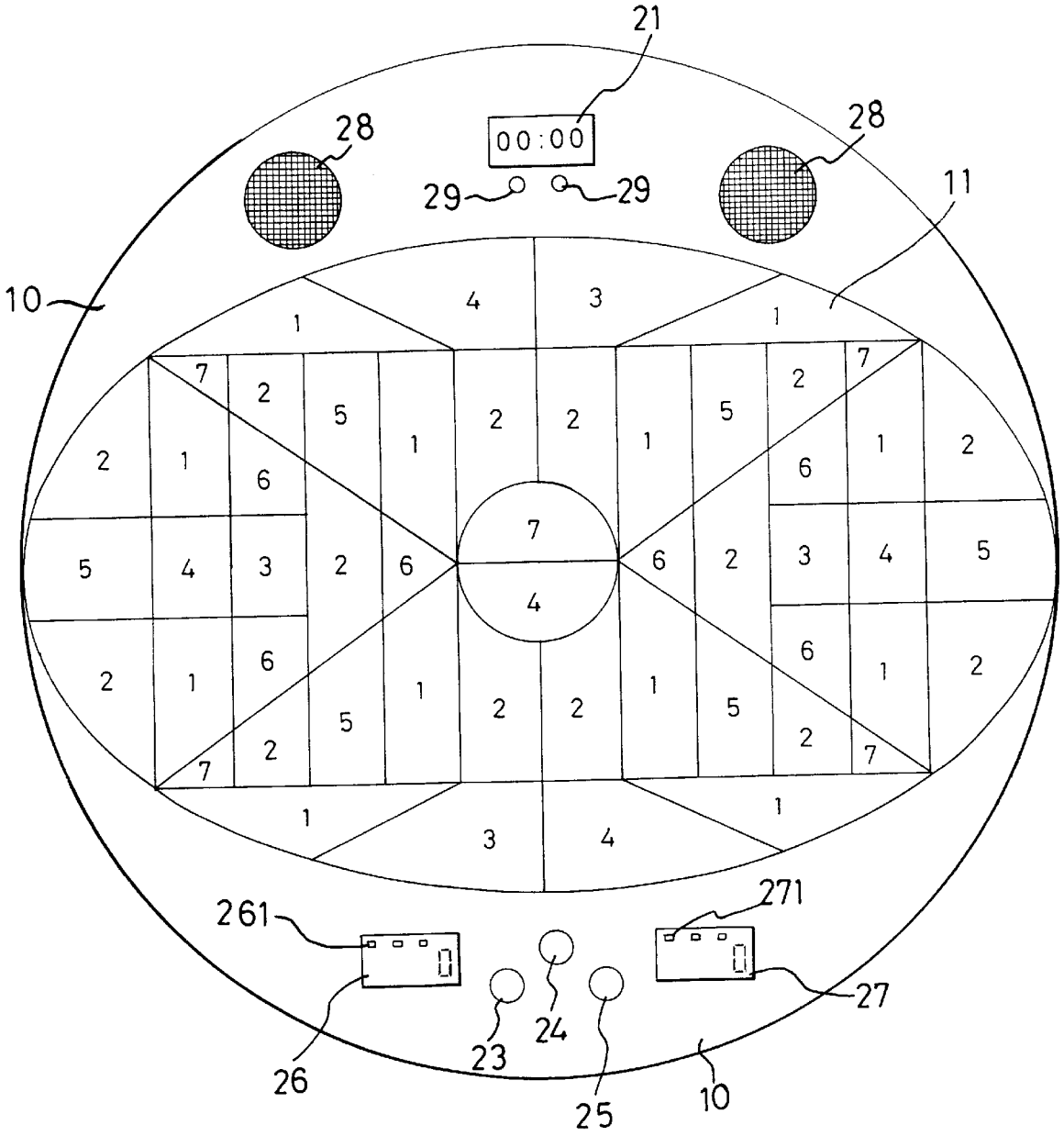
FIG. 2 is a schematic view showing the electrical scoring dart target configured to be an "American football" competition in accordance with the present invention.

FIG. 1 and FIG. 2 are schematic views showing an electrical scoring dart target configured to be a "soccer" competition and an "American football" competition respectively in accordance with the present invention. The electrical scoring dart target includes a target 10. The target 10 defines a plurality of target areas 11 which are distinguished by size, shape and color thereof. Each target area 11 has a sensing plate (not shown) disposed at a bottom thereof so as to detect a hit to the target area 11 and send signals to a control circuit provided within the target 10. The dart target further includes two loudspeakers 28, a first score display 26 and a second score display 27, a plurality of function keys 23, 24, 25, two pilot lamps for indicating attack, and a clocking display 21 arranged at an upper portion or a lower portion thereof.

To provide more enjoyable and attractive game modes, the electrical scoring dart target in accordance with the present invention is designed to be adapted for soccer, "American football", "basketball" and other "sports" competitions. In detail, the target areas 11 of the target 10 of the dart target are divided into a frustration region, an offense/defense interactive region, and an offensive gain region.

In FIG. 1, the target areas 11 with the numbers 1–4 are included in the frustration region, respectively representing offside, yellow card warning, out-of bounds, and interception. The target areas 11 with the numbers 5–7 are included in the offense/defense interactive region, respectively representing a free kick, a corner kick, and a penalty kick. The target areas 11 with the numbers 8–10 are included in the offensive gain region, respectively representing long pass, short pass, and head pass. Also, two players can be distinguished to an attacker and a defender. If the frustrating region is hit, the attacker and the defender should exchange. If the offensive gain region is hit, the attacker will be allowed to continuously play. When the offense/defense interaction region is hit, it means that the attacker is executing the free kick, the corner kick, or the penalty kick and then the defender can determine whether the attacker is successful by hitting the target area 11. If the defender hits one target area 11 in the frustration region, it is determined that the attacker has failed. With this arrangement, the electrical scoring dart target provides the players with an exciting "soccer" competition effect.

In FIG. 2, the target 10 is configured as an elliptical "American football" competition ground. The target areas 11 with the numbers 1–2 are included in the frustration region, respectively representing yard loss, ball loss and intercept. The target areas 11 with the numbers 3–5 are included in the offense/defense interaction region, respectively representing a pass, yard-running, and kick. The target areas 11 with the numbers 6–7 are included in the offensive gain region, respectively representing yard access, and arrival. Similar to the principle of FIG. 1, when the offense/defense interaction region is hit, it means that the attacker is passing a ball, running yards or kicking the ball, and whether the attacking score is effective or not can be determined by the defender hitting the target area 11.

In addition to the above mentioned competition modes, the electrical scoring dart target can be designed for "basket ball" and some other "sports" competitions.

Figure 3:
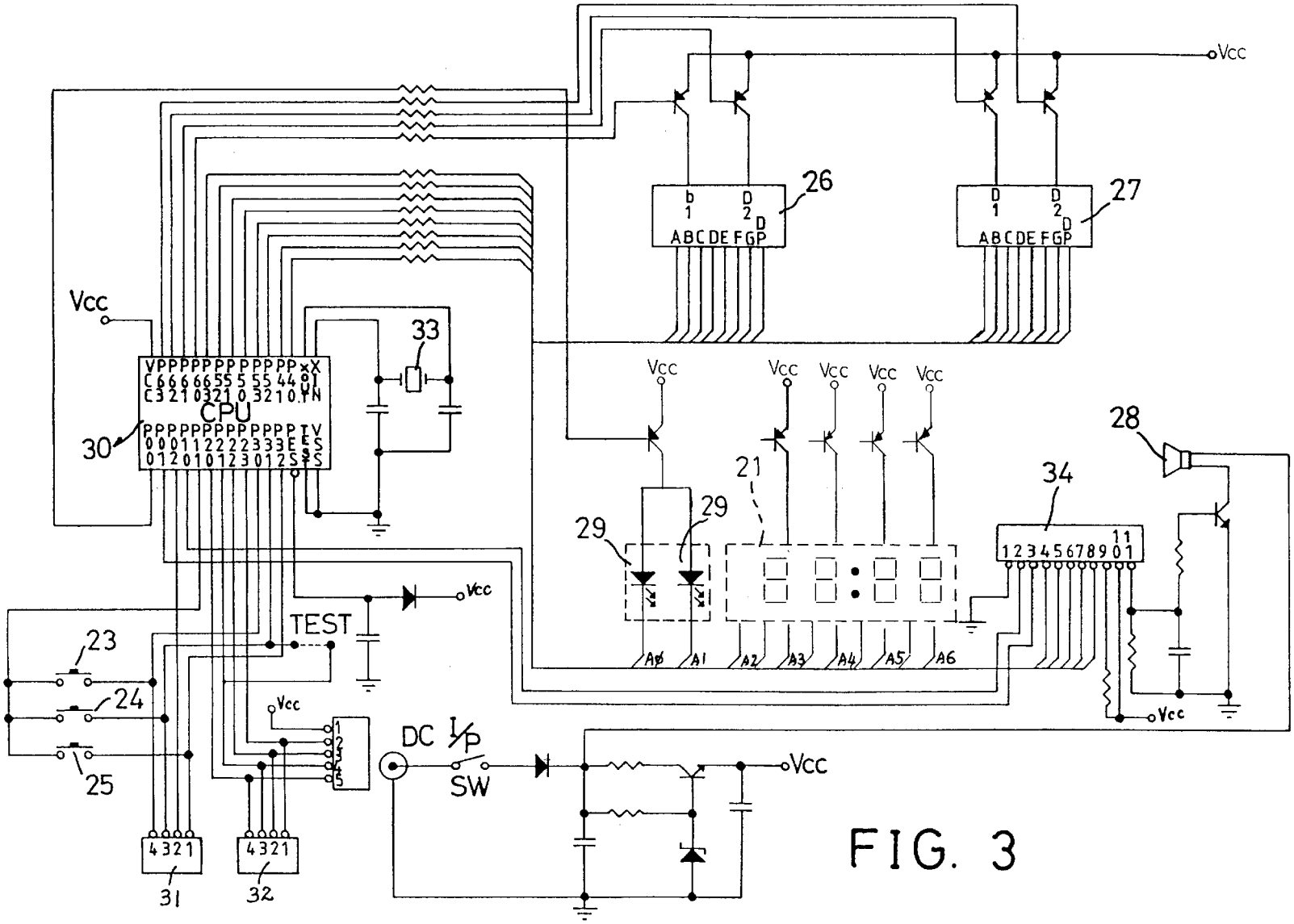
FIG. 3 is a circuit diagram of the electrical scoring dart target in accordance with the present invention.

FIG. 3 shows a circuit diagram of the control circuit in the electrical scoring dart target in accordance with the present invention, The control circuit includes a control center (not numbered) composed of a central processing unit (CPU) 30 and a quartz oscillator 33. A number of output/input ports below the CPU 30 are respectively connected to the function keys 23, 24, 25 of FIG. 1 and FIG. 2, and to the sensing plate of the target 10 via a fist connector 31 and a second connector 32 so that the CPU 30 can detect a hit to the target areas 11. A number of output/input ports above the CPU 30 respectively drive the first and second score displays 26, 27, the pilot lamps 29 indicating attack, the score displays 21, and a voice integrated circuit 34. An output terminal of the voice integrated circuit 34 is connected to the loudspeakers 28 in order to provide a sound effect during the competition.

Figure 4:
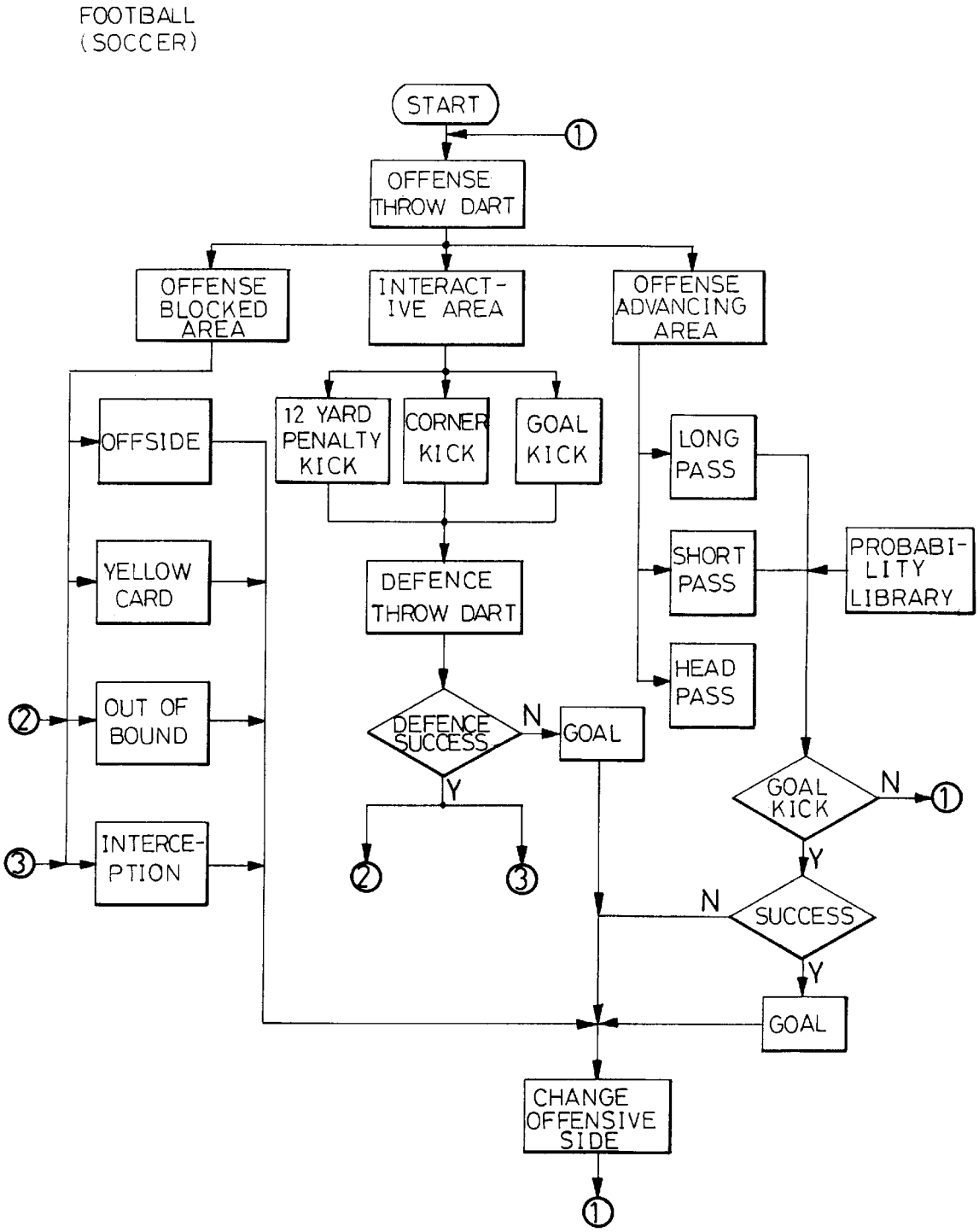
FIG. 4 is a flow chart of the "soccer" competition provided by the electrical scoring dart target in accordance with the present invention.

FIG. 4 is a flow chart of the "soccer" competition provided by the electrical scoring dart target in accordance with the present invention. In this embodiment, the "soccer" competition is carried on with the following steps. After powering on the dart target and setting the target with function keys 23, 24, 25, the attacker firstly throws a dart at the target. If a target area 11 in the offensive gain region is hit, it is understood that the attacker is passing a ball for a long distance, a short distance, or by head. At this time, the CPU 30 will select any digital data from a proportional yard random table to indicate the yardage of the long pass, short pass or head pass. If the yardage enables the attacker to be in a shooting state, whether the shot is successful or not can be determined by the defender hitting the target 10, and if not successful, he/she must return to the beginning (first step). If the shot of the attacker is successful, the score display 26 will display the score of the attacker, and if not, the attacker and the defender should exchange. If a target area 11 in the frustration region is hit, it is understood that the attacker is offside, receiving a yellow card warning (foul), out-of bounds or has been intercepted, therefore, the attacker and the defender should exchange. If a target area 11 in the offense/defense interaction region is hit, it is understood that the attacker is in the free kick, the corner kick or the penalty situation. At this moment, the defender throws at the target 10. If the defender hits the offensive gain region, that means the defense of the defender has failed and the attacker scores one point. If the defender hits the frustration region, that means the defense of the defender is successful and the defender begins to attack. The "soccer" competition provided by the dart target can last to the pre-set time of clocking by loopingly executing above mentioned steps. Finally, the winner is determined by the separate total scores of the attacker and the defender.

Figure 5:
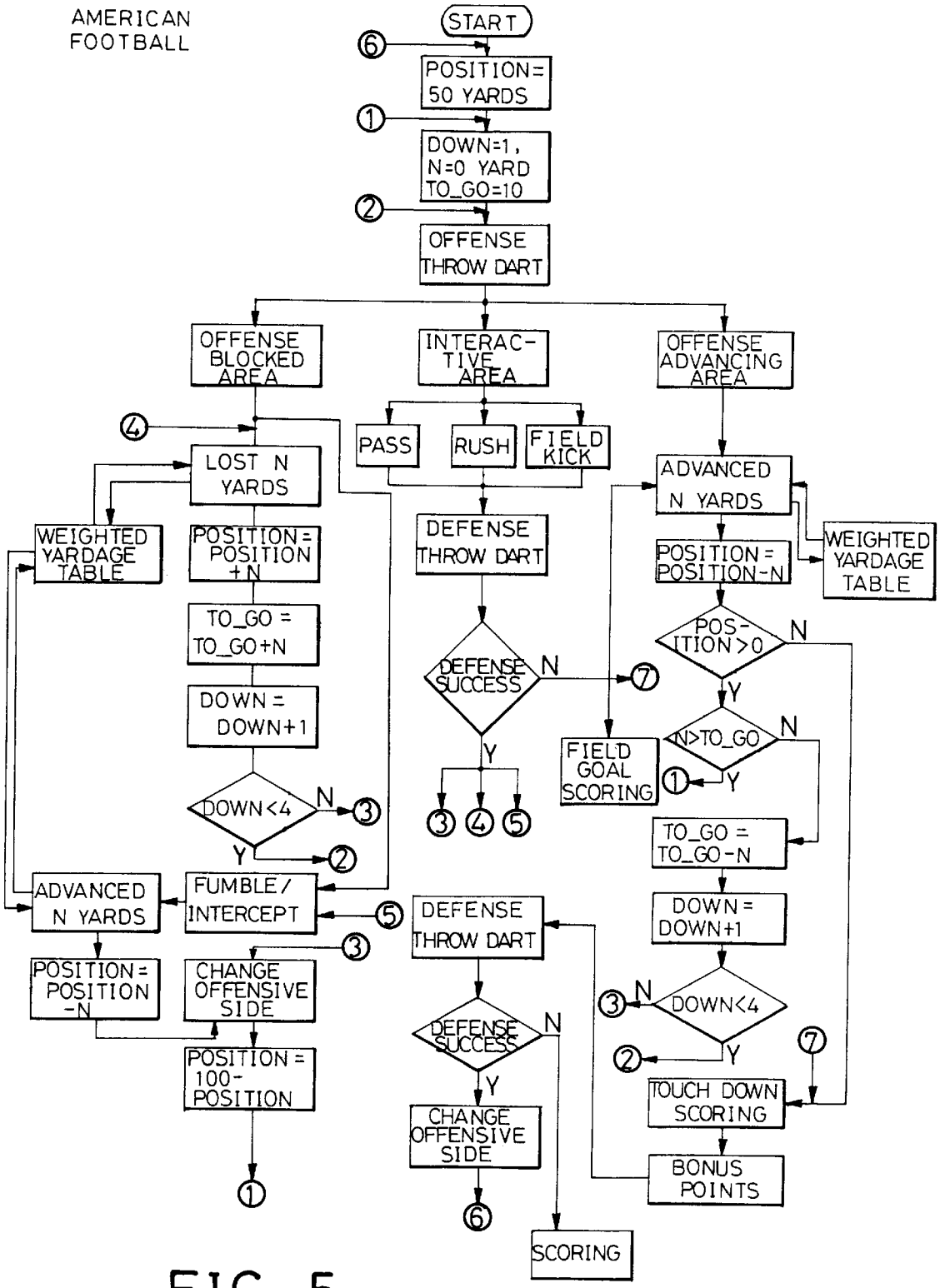
FIG. 5 is a flow chart of the "American football" competition provided by the electrical scoring dart target in accordance with the present invention.

FIG. 5 is a flow chart of the "American football" competition provided by the electrical scoring dart target in accordance with the present invention. In this embodiment, the "American football" competition is carried out with the following steps. At sign 1, the players can set an attacking position to 50 yards and execute an initialization step, i.e, setting one "down", setting zero pushing yardage and setting zero attacking yardage. At sign 2, the attacker firstly hits -he target. If a target area 11 in the offensive gain region is hit, the CPU 30 will select any digital data n from a proportional yard random table to indicate the pushing yardage. Then the attacker pushes n yards. If the attacking position is determined to be zero (i.e, touch down), the attacker enters sign 7 of touch down scoring, and then goes to the bonus goal kick. Whether the bonus goal kick is successful or not is determined by the defender hitting the target 10. If successful, the attacker will score, and if not, the attacker and the defender should exchange and enter sign 6 (return to the beginning). If the digital date n is more than 10 yards, then the attacker goes back to the step 1, and if not, accumulates the yardage and the account of "down". If the account of "down" is determined to be less than four, sign 2 is entered, while if the account of "down" is determined to be more than four, sign 3 is entered and the attacker and the defender are exchanged.

Still at sign 2, if the attacker hits the frustration region, there are two situations, one is yard loss and the other is ball loss/intercept. If the target area 11 indicative of yard loss is hit, the CPU 30 will select digital data n from the proportional yard random table to indicate the lost yardage. Then the attacker returns to the attacking position by n yards, decreases the attacking yardage, and accumulates the account of "down". If the account of "down" is determined to be less than four, sign 2 is entered, while if the account of "down" is determined to be more than four, sign 3 is entered and the attacker and the defender are exchanged. If the target area 11 is indicative of ball loss/intercept, the attacker pushes the attacking position for n yards and then exchanges with the defender.

Still at sign 2, if the attacker hits the offense/defense interaction region, whether the ball-passing, yard-running or kicking is successful is determined by the defender hitting the target 10. If the defense of the defender fails, i.e, the offensive gain region is hit and the target area 11 indicative of yard-running is hit, the attacker pushes n yards, then if the attacker hits the arrival target area 11, the attacker will score. If the defense of the defender :s successful, i.e, the target area 11 indicative of yard loss or ball loss/intercept is hit, the attacker returns attacking position by n yards or enters the sign 5.

With this arrangement, the "American football" competition provided by the dart target can last to the pre-set time of clocking by loopingly executing above mentioned steps. The final winner is determined by the respective total scores of the attacker and the defender.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical scoring dart target comprising:

a target defining a plurality of target areas, said target areas being divided into a frustration region, an offense/defense interaction region, and an offensive gain region;

a control panel adapted to the target; and a control circuit provided within the target.

2. The electrical scoring dart target as claimed in claim 1, wherein said control panel has at least one set of score display and at least one set of function keys.

3. The electrical scoring dart target as claimed in claim 1, wherein said plurality of target areas are configured as a competition ground for "soccer", "American football", "basketball" or some other "sports."

4. The electrical scoring dart target as claimed in claim 1, wherein said plurality of target areas are distinguished by color.

5. The electrical scoring dart target as claimed in claim 1, wherein said plurality of target areas are distinguished by respective shape.

6. The electrical scoring dart target as claimed in claim 2 further comprising a clocking display for indicating attack.

7. The electrical scoring dart target as claimed in claim 2 further comprising a set of pilot lamps for indicating attack.

* * * * *